US009526305B2

(12) United States Patent
Granito

(10) Patent No.: US 9,526,305 B2
(45) Date of Patent: Dec. 27, 2016

(54) DEVICE FOR ADJUSTING THE USABLE LENGTH OF A BRACELET AND CORRESPONDING BRACELET CLASP

(75) Inventor: Elio Granito, Schwadernau (CH)

(73) Assignee: DEXEL S.A., Bienne (CH)

( * ) Notice: Subject to any disclaimer, the term of this patent is extended or adjusted under 35 U.S.C. 154(b) by 877 days.

(21) Appl. No.: 13/291,770

(22) Filed: Nov. 8, 2011

(65) Prior Publication Data

US 2012/0110792 A1 May 10, 2012

Related U.S. Application Data

(63) Continuation-in-part of application No. PCT/EP2010/002872, filed on May 10, 2010.

(30) Foreign Application Priority Data

May 8, 2009 (EP) ..... 09159818

(51) Int. Cl.

| | |
|---|---|
| ***A44B 11/00*** | (2006.01) |
| ***A44C 5/24*** | (2006.01) |
| ***A44C 5/22*** | (2006.01) |
| *A44C 5/18* | (2006.01) |

(52) U.S. Cl.

CPC ..... *A44C 5/246* (2013.01); *A44C 5/22* (2013.01); *A44C 5/185* (2013.01); *Y10T 24/4745* (2015.01)

(58) Field of Classification Search

CPC ..... A44C 5/14; A44C 5/2047; A44C 5/2052; A44C 5/2057; A44C 5/246; A44C 11/246; A44C 11/266; A44C 11/2511; A44C 1/008

USPC ..... 24/71 J

See application file for complete search history.

(56) References Cited

U.S. PATENT DOCUMENTS

| | | | | |
|---|---|---|---|---|
| 1,786,943 | A * | 12/1930 | Gammell | 24/68 J |
| 1,985,835 | A * | 12/1934 | Prestinari | 24/71 J |
| 7,289,310 | B1 * | 10/2007 | Yuan | 361/220 |

* cited by examiner

*Primary Examiner* — Robert J Sandy
*Assistant Examiner* — Matthew Sullivan
(74) *Attorney, Agent, or Firm* — Finnegan, Henderson, Farabow, Garrett & Dunner, L.L.P.

(57) ABSTRACT

A device for adjusting the length of a bracelet comprises a frame carrying an adjusting element capable of sliding in the longitudinal direction of the bracelet, and an element for fastening the bracelet, mechanically connected to the frame. The device comprises a jaw which can move in response to an action by a user on a control element, and is designed to lock the adjusting element or leave it free, to define several adjustment positions. The device has an automatic conversion mechanism designed to convert an action on the control element into a sliding movement by one increment of the adjusting element, to adjust the length of the bracelet.

20 Claims, 8 Drawing Sheets

DEVICE FOR ADJUSTING THE USABLE LENGTH OF A BRACELET AND CORRESPONDING BRACELET CLASP

This application is a continuation-in-part application of prior International Application No. PCT/EP2010/002872 , filed on May 10, 2010 and claiming priority to European (EP) patent application Ser. No. 09159818.5 , filed May 8, 2009.

TECHNICAL FIELD

The present invention relates to a device for adjusting the usable length of a bracelet, for a bracelet of the type comprising first and second free ends.

To be more precise, the adjusting device according to an embodiment has a frame carrying

- an adjusting element intended to be fastened with a first free end of the bracelet and capable of sliding in the longitudinal direction of the bracelet with reference to the frame,
- an element for fastening the bracelet, mechanically connected to the frame and intended to be fastened with the second free end of the bracelet,
- a jaw which can move between an active or closed position and an inactive or open position, in particular in response to a predefined action by a user on a control element, and is designed so as to
- lock the adjusting element in the active position, and
- leave it free in the inactive position, so as to define a plurality of distinct adjustment positions in the longitudinal direction of the bracelet, two adjacent distinct positions defining an adjustment increment for the usable length of the bracelet.

BACKGROUND

Many adjusting devices of this type have already been disclosed, in most cases incorporated directly into bracelet clasps.

By way of example, patent application EP 1378185 A1 describes such a device which may or may not be incorporated into a bracelet clasp. This device has a frame with means for attachment to a bracelet, at one of its ends. An adjusting element is mounted so that it can slide in the frame and is provided with a plate in which a rack is formed. Jaws which can be actuated by push buttons are arranged in the frame so as to interact with the notches of the rack and lock the adjusting element in the desired position.

Thus, as with all known adjusting devices of this type, a user who wishes to alter the length of his bracelet must press the push buttons in order to free the adjusting element and then act on the bracelet, in order to lengthen or shorten it by displacing the adjusting element with reference to the frame of the device. Generally, the teeth of the rack are asymmetrical and oriented in such a way that the user can shorten his bracelet without having to free the rack by actuating the push buttons.

Alternative adjusting devices were known before, such as for example in the patent U.S. Pat. No. 1,997,836, in which a jaw acts on a rack so as to define distinct adjustment positions. This document provides that two blades are mounted so that they can slide relative to each other, with a spring placed between them, in such a way that, when the rack is freed, the two blades are placed in a relative position such that the length of the device is at its maximum. The user must then take hold of the two blades, bring them together and reduce the length of the device as required.

However, even when the device only needs to be adjusted by a few increments of the rack, the whole procedure must nevertheless be followed, including necessarily the stage with the configuration of the maximum length, which is not very convenient in practice.

SUMMARY

One of the main aims of the present invention is to improve the ergonomics of the adjusting devices known from the prior art by providing a device for adjusting the usable length of a bracelet, offering convenient handling which consists in particular of simply actuating the control element of the device.

To this end, the present invention relates more particularly to an adjusting device of the abovementioned type, further having an automatic conversion mechanism designed to convert the predefined action of the user on the control element into a sliding movement by one increment of the adjusting element, and allow the usable length of the bracelet to be adjusted.

Advantageously, the conversion mechanism may comprise a rack integral with the adjusting element and interacting with the movable jaw so as to define the distinct adjustment positions.

By virtue of these features, simple repeated actions on the control element of the adjusting device, preferably pushing actions, may make it possible to alter the length of the bracelet automatically, by increments, without the user having to pull on the bracelet at the same time as acting on the control element. Indeed, the action of the user on the control element may be converted or transformed, by the automatic conversion mechanism, into a displacement of the adjusting element by one adjustment increment in the longitudinal direction of the bracelet so as to either shorten or lengthen it.

The adjusting device may preferably also comprise a knife designed so as to displace the jaw into its inactive position, in response to the predefined action of the user on the control element, and a first pusher designed so as to exert a pressure, having a component oriented in a first direction in the longitudinal direction of the bracelet, on a first abutment surface mechanically connected to the adjusting element, when the jaw is placed in its inactive position by the knife.

The control element thus not only serves to free the rack, as in the case of the devices from the prior art, but may also control an automatic displacement action of the adjusting element via the pusher.

The conversion mechanism may preferably also have a stop surface which may be arranged so as to interact with the adjusting element when the latter has completed the predefined displacement movement.

According to an advantageous embodiment, the first pusher may be arranged on the adjusting device to enable it to move between first and second configurations, so that it may be capable of acting on the first abutment surface in the first configuration and so that it may be capable of acting on a second abutment surface when it is placed in its second configuration, in order to exert on it a pressure oriented in the opposite direction to the first direction.

Acting on the control element in the first configuration may thus cause the bracelet to be automatically lengthened, whereas acting on the second configuration may cause it to be shortened.

It may particularly advantageously be provided that just a simple pressing action, which can be made using just one finger, may displace the adjusting element by one increment in one or another direction, depending on the configuration of the control element. Such an action requires much less dexterity on the part of the user than the adjusting devices from the prior art.

It may be provided that the device has an additional rack with a plurality of notches, the pusher being capable of pivoting with reference to the control element in order to act on a first notch of the rack in a first configuration, and on a second notch of the rack in the second configuration.

It is also possible to provide an alternative embodiment in which the conversion mechanism may have a second pusher designed so as to exert a pressure, having a component oriented in the longitudinal direction of the bracelet, in the opposite direction, on a second abutment surface mechanically connected to the adjusting element when the jaw is placed in its inactive position by the knife, the first and second pushers being capable of moving between first and second configurations in such a way that only the first pusher may be active in the first configuration, whereas only the second pusher may be active in the second configuration.

In this case, it may also be provided that the device has an additional rack designed so that it engages with a toothed pinion, the pushers being designed so as to be able to act on the pinion in order to rotate it in opposite directions of rotation.

The user may thus decide, simply by acting on the control element of the device, in other words without having to act on the bracelet itself, to shorten or lengthen said bracelet.

The present invention also relates to a bracelet clasp having an adjusting device with the features explained above.

BRIEF DESCRIPTION OF THE DRAWINGS

Other features and advantages of the present invention will become more apparent on reading the following detailed description of preferred embodiments, made with reference to the attached drawings which are given by way of example and with no limitation implied, and in which.

DETAILED DESCRIPTION

Figure 1:
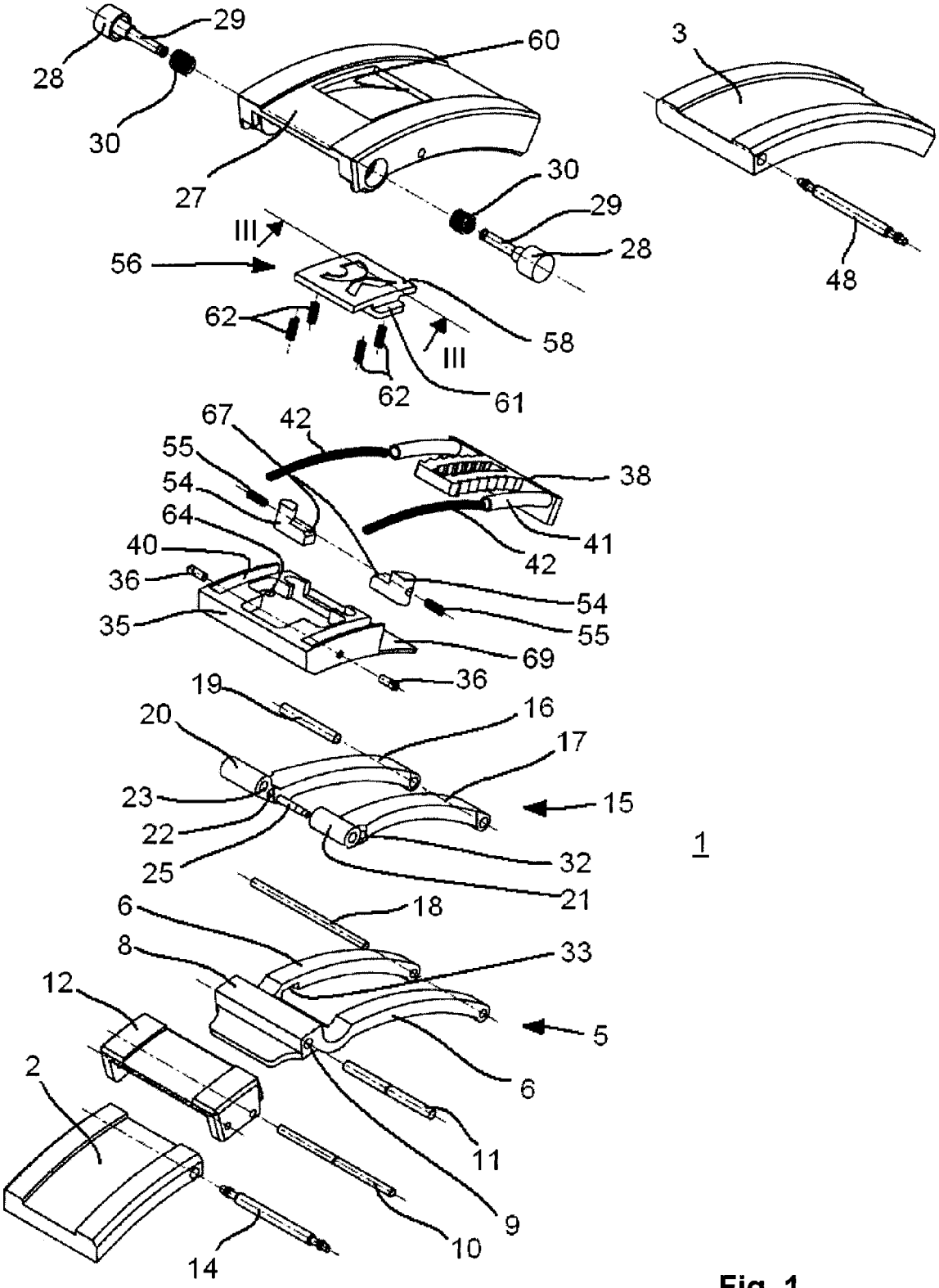
FIG. 1 shows an exploded perspective view of a bracelet clasp according to a first preferred embodiment of the present invention.

The device for adjusting the usable length of a bracelet, illustrated in the Figures with no limitation implied, is an integral part of a clasp of the folding buckle type, and corresponds to a preferred embodiment of the present invention. The adjusting device according to the invention can of course be assembled with a bracelet independently of its clasp, in a similar manner to the alternative embodiments described in the patent application EP 1378185 A1 already mentioned.

More precisely, it will be noted that the clasp illustrated by way of example is described in detail in the patent EP 0 913 106 B1, granted in the name of the Applicant.

Constituent elements of the clasp which are identical in the different embodiments presented have been given the same reference numerals for greater clarity.

As can be seen in FIG. 1, the clasp 1 is intended to be connected to two free ends 2 and 3 of a bracelet.

As described in the abovementioned patent EP 0 913 106 B1, the clasp has a base 5, with an elongated shape in the longitudinal direction of the bracelet and slightly curved over at least part of its length so that it better matches the shape of the wearer's wrist. The base 5 comprises two spaced-apart side pieces 6 integral with a transverse spacer 8 arranged at a first end of the side pieces 6. The spacer has a cylindrical bore 9 intended to house a pin 10, which is itself housed inside a hollow tube 11, in order to fasten the base 5 to a cap 12. The latter itself forms a fastening element intended to be connected to the first free end 2 of the bracelet via a spring pin 14.

A folding arm 15 formed by two limbs 16, 17 is connected to the opposite end of the side pieces 6, via a pin 18—hollow tube 19 unit arranged in suitable holes.

The opposite ends of the limbs 16, 17 have barrels 20, 21, each equipped with two holes 22, 23. A rod 25 is arranged inside the pair of holes 22 in order to ensure that the barrels 20, 21 are positioned properly relative to each other.

The second pair of holes 23 is provided in order to assemble the folding arm 15 with a cover 27 of the clasp, by means of two lateral pushers 28, each of which has a rod 29 engaging in the corresponding hole 23.

Springs 30 are placed in between the cover 27 and each of the pushers 28 in order to exert a force on said pushers 28 which tends to hold them apart from each other.

The pushers 28 are designed so as to act on the limbs 16, 17 in order to bring them closer together when they are actuated by a user who wants to open the clasp 1. Bringing the limbs 16, 17 closer together releases prongs 32 formed on the limbs 16, 17 and inserted into complementary recesses 33 formed in the base 5, as was described in detail in the patent EP 0 913 106 B1.

The device for adjusting the usable length of the bracelet according to the invention is associated with the base structure of the clasp 1, and in particular is housed beneath the cover 27.

The adjusting device has a frame 35 mechanically connected to the cover 27 by means of screws 36 and defining a support for an adjusting element 38. The frame 35 has recesses with shapes that substantially complement those of the adjusting element 38, in particular grooves 40 which are intended to house tubes 41.

Springs 42 are arranged inside the tubes 41 with their free end placed abutting the bottom of the corresponding groove 40. The springs 42 thus tend to push the adjusting element 38 out of the frame 35, in a direction corresponding to a lengthening of the bracelet.

Figure 2:
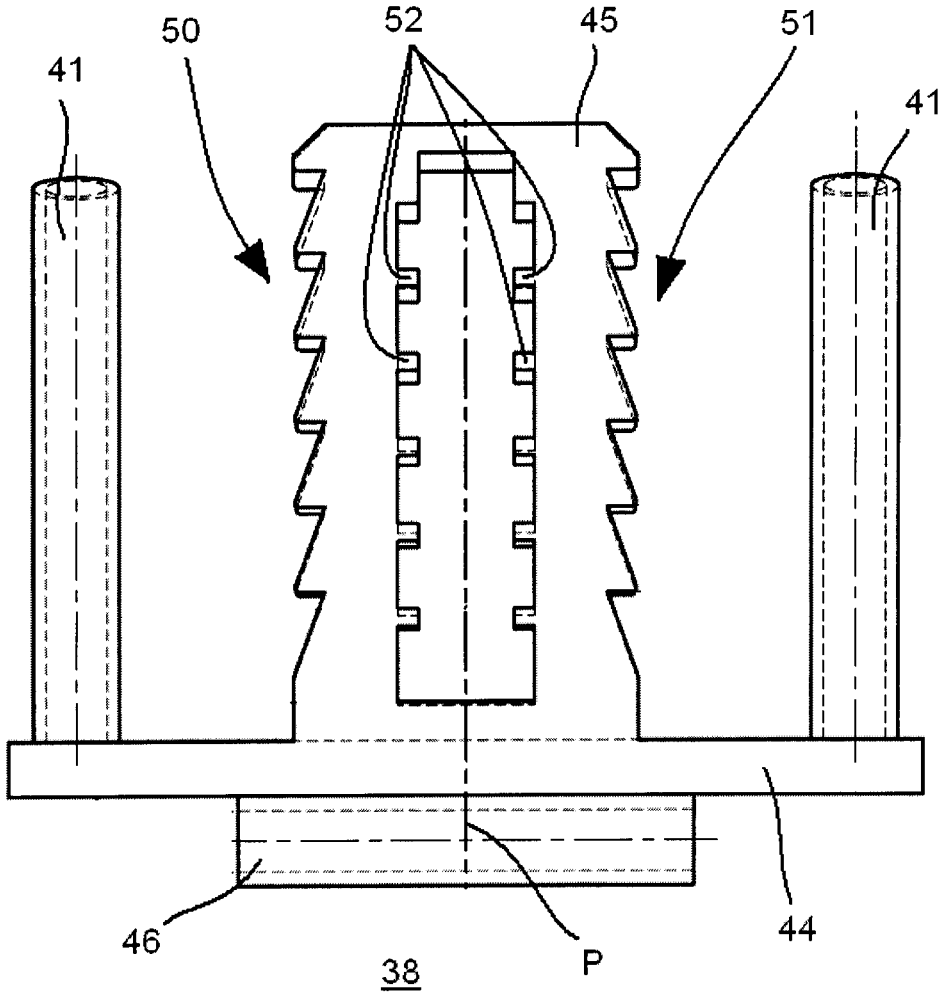
FIG. 2 shows a view from above of a first constituent element of the clasp in FIG. 1.

FIG. 2 shows a detailed view from above of the adjusting element 38.

The adjusting element 38 comprises a base 44 which is elongated in a direction perpendicular to the longitudinal direction of the bracelet, the tubes 41 extending from the ends of said base 44. A plate 45, which is elongated in the longitudinal direction of the bracelet, is integral with the base 44, in its central region and on the same side of the base as the tubes. A cylinder 46 is integral with the central region of the base 44, on the opposite side to that of the plate 45, and is intended to allow a mechanical connection to be established with the second free end 3 of the bracelet by means of a spring pin (reference numeral 48 in FIG. 1).

The plate 45 is equipped with two sets of sawtooth-shaped teeth 50, 51 which are symmetrical about the median plane P of the adjusting element 38 and define two racks.

Moreover, the plate 45 has a recess in its central part, inside which a ladder is formed with rungs 52 which are interrupted in their central region and the function of which will be explained below.

Referring back to FIG. 1, it will be noted that the adjusting device also comprises a pair of jaws 54 intended to be arranged in a suitable recess of the frame 35 in order to interact with the teeth of the racks 50, 51. Springs 55 are placed between the jaws 54 and the frame 35 so as to push the jaws towards each other, in a locked position, in other words in which they are positioned abutting the teeth 50, 51 in order to immobilize the adjusting element 38.

The adjusting device also has a control element 56 housed between the cover 27 and the frame 35. The control element comprises a control plate 58 arranged in a suitable opening 60 in the cover 27 and intended to be actuated by a user. Tabs 61 are provided on either side of the control plate in order to retain the control element in the cover.

The control element 56 is suspended on the frame 35 by means of four springs 62, each of which has one end housed in a blind hole 64 of the frame 35.

Figure 3:
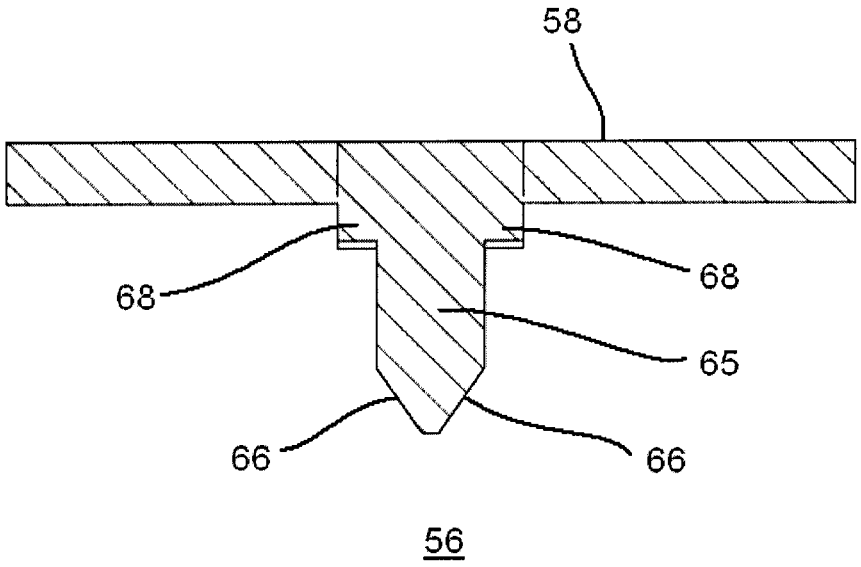
FIG. 3 shows a view in cross-section of a second constituent element of the clasp in FIG. 1, along the line III-III in FIG. 1.

As can be seen more clearly in the view in cross-section of the adjusting element 38 in FIG. 3, on the opposite side to that of the control plate 58 it has a knife 65 with two oblique surfaces 66 intended to interact with suitable surfaces 67 of the jaws 54, arranged beneath the ladder of the adjusting element, in order to space them apart from each other and release the racks 50, 51 when a user exerts pressure on the control element towards the frame 35.

Furthermore, two projections 68 are formed on either side of the knife 65, the projections having a substantially smaller length than the knife.

These projections 68 are preferably designed to fulfill a stop function, being intended to define the length of the displacement made by the adjusting element.

Indeed, referring back to FIG. 1, it should be noted that the control element 56 and the adjusting element are positioned and dimensioned in such a way that when the former is actuated by a user, it effects a displacement towards the latter in such a way that the knife frees the racks 50, 51, as mentioned above, and that the force exerted by the springs 42 against the bottom of the grooves 40 tends to displace the adjusting element in a direction corresponding to a lengthening of the bracelet (in other words, to the right in FIG. 1). This displacement continues until the projections 68 come into contact with substantially inclined abutment surfaces of the rungs 52, in order to fulfill the role of stops.

When the user lets go of the control element 56, the knife 65 frees the jaws 54 just before the projections 68 are released from the rungs 52, which guarantees that the adjusting element 38 is locked after it has advanced by just one increment.

Thus, each time that the user presses on the control element 56, the adjusting element 38 advances by an extra increment so as to further lengthen the length of the bracelet, without the user needing to handle the bracelet.

It is clear from FIG. 1 that the frame 35 advantageously has a lip 69 forming a guide support for the adjusting element when the latter is withdrawn from the frame.

According to this first preferred embodiment, the specific shape of the sawtooth-shaped teeth of the racks 50, 51 allows the user to shorten the bracelet simply by pushing the adjusting element inside the clasp 1, by acting, for example, on the free end 3 of the bracelet towards the clasp. The teeth then act on the jaws 54 so as to overcome the force of the springs 55.

It will be noted that it is not absolutely essential to provide two racks and two jaws to implement this first embodiment, but this does guarantee more accurate and more reliable functioning of the adjusting device.

Figure 4:
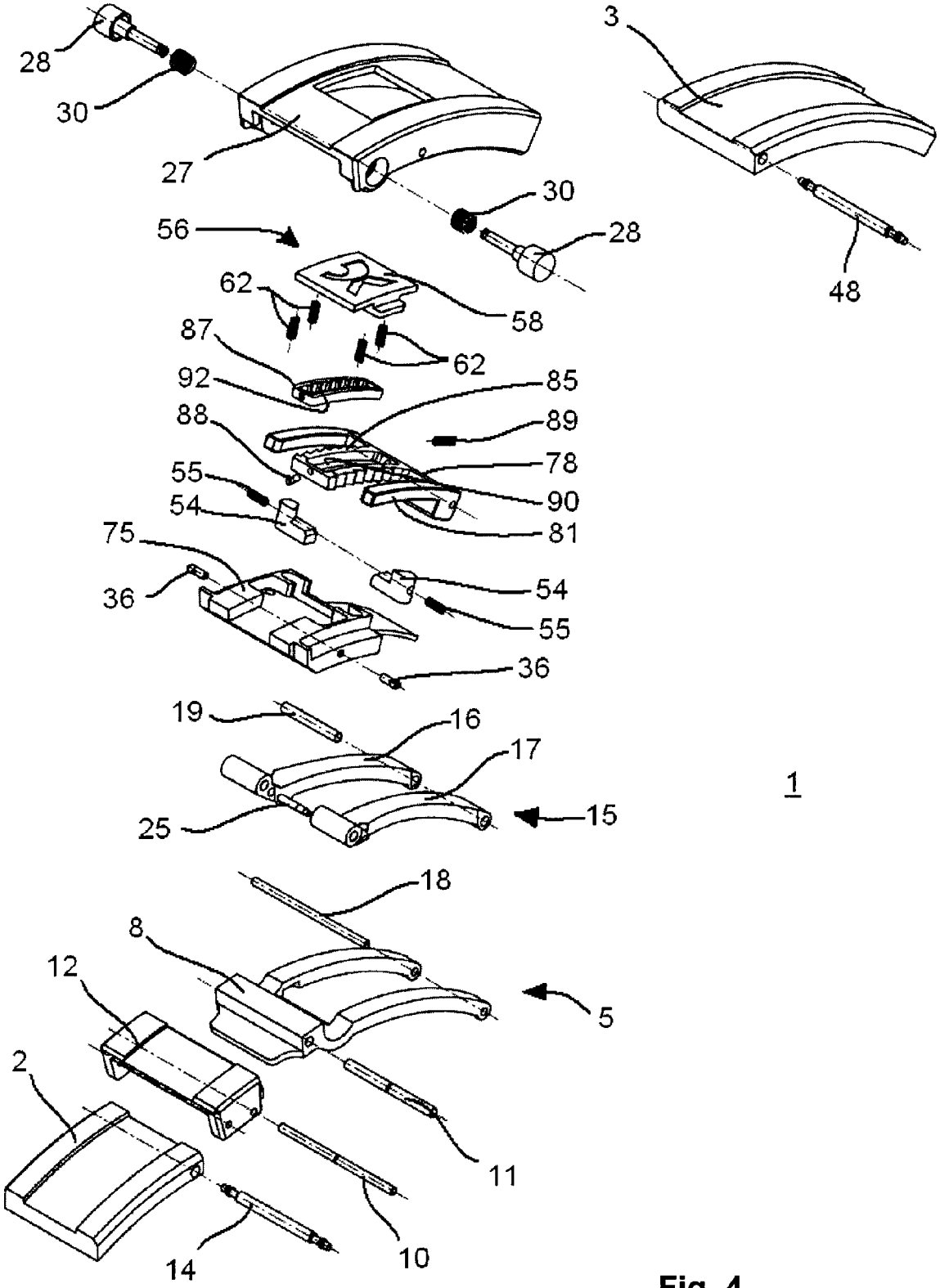
FIG. 4 shows an exploded perspective view of a bracelet clasp according to a second preferred embodiment of the present invention.

FIG. 4 shows, in a view similar to the view in FIG. 1, a clasp of the same type which incorporates a device for adjusting the usable length of the bracelet according to a second embodiment of the present invention.

In this embodiment, only the frame 75 and the adjusting element 78 have different shapes from those described in relation to the first embodiment.

The adjusting element 78 comprises optional guide pillars 81 instead of the tubes 41, whereas the corresponding recesses 84 of the frame 75 have a suitable shape.

Moreover, the central plate 85 of the adjusting element has a recess 86 intended to house a ladder 87 which takes the form of a separate piece. The ladder 87 is assembled in the central plate 85 by means of a small rod 88 and a spring 89, arranged on either side of the ladder, which is consequently mounted in the adjusting element with a small amount of play in the longitudinal direction of the bracelet. The ladder rests on a bottom 90 of the central plate 85, the bottom being equipped with a central longitudinal slot in order to define a passage for the knife 65.

Rungs 92, which are interrupted in their central region and are similar to the rungs 52 of the first embodiment, are formed in the ladder 87 to interact with the projections 68 of the control element 56.

The adjusting device according to this second embodiment functions in a similar way to the adjusting device according to the first embodiment. However, it differs in that the spring 89 is compressed after the ladder has been displaced, in response to the action of the projection 68, the spring then, as it slackens, imparting a force to the adjusting element to displace it further in the direction lengthening the bracelet, in other words to complete the increment of the displacement which was initiated by the action of the pusher.

Figure 5:
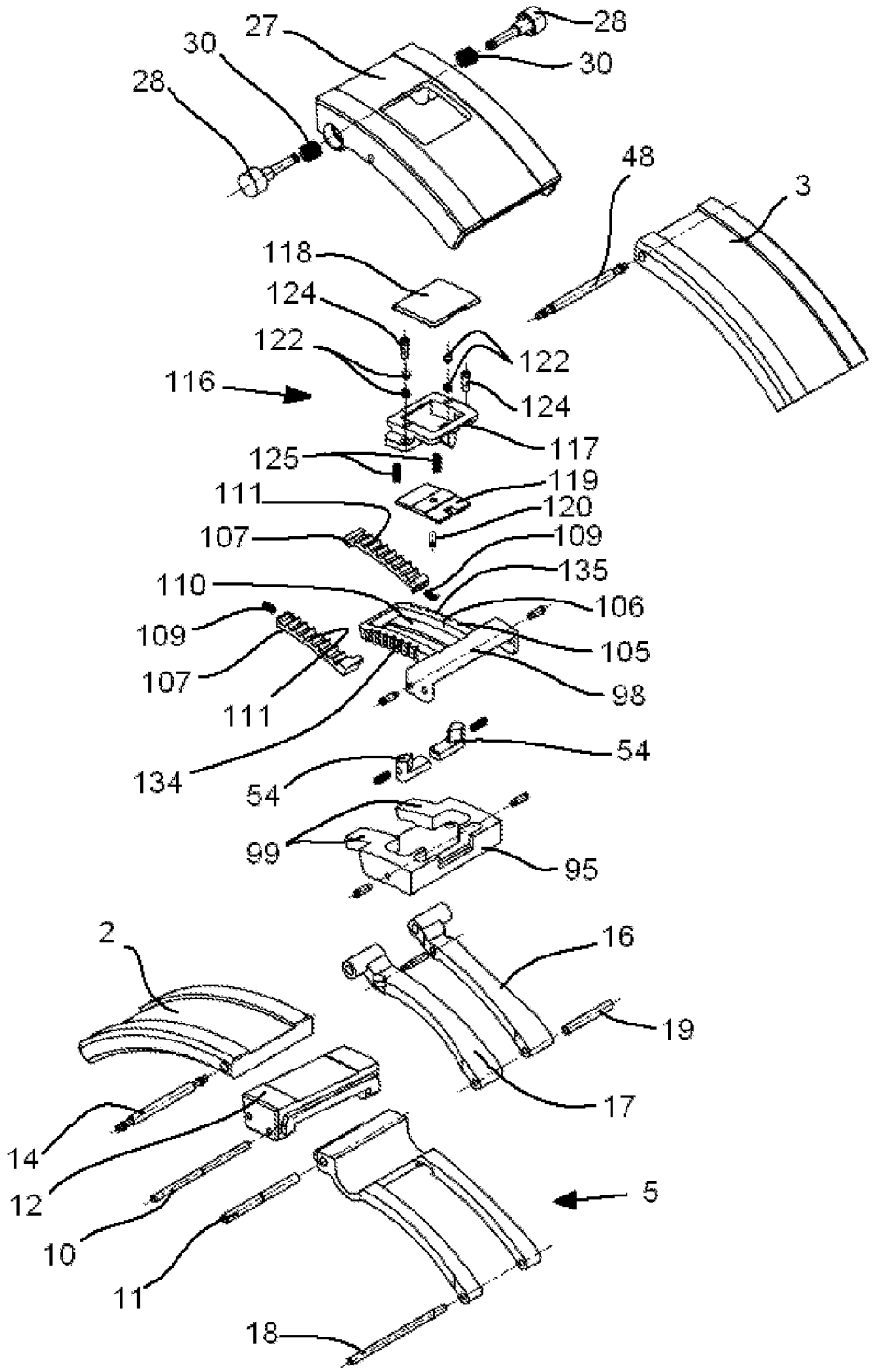
FIG. 5 shows an exploded perspective view of a bracelet clasp according to a third preferred embodiment of the present invention.

FIG. 5 shows, in an exploded perspective view, a clasp of the same type as that in FIG. 1 incorporating a device for adjusting the usable length of the bracelet according to a third embodiment of the present invention.

In this embodiment, it is provided that the adjusting device makes it possible to adjust the length of the bracelet so as to shorten or lengthen it automatically, as was described above in relation to lengthening the bracelet.

The adjusting device comprises a frame 95 with recesses intended to house an adjusting element 98 and the jaws 54. The frame 95 also comprises two extensions 99, in the longitudinal direction of the bracelet, defining lateral guide surfaces for the adjusting element 98.

The latter comprises a central plate 105, widened in comparison with the above embodiments, with a recess 106 intended to house two toothed rungs 107. The rungs 107 are assembled in the central plate 105 by means of springs 109, arranged between each rung and the central plate. Each rung is thus mounted in the adjusting element with a small amount of play in the longitudinal direction of the bracelet. The rungs rest on a bottom 110 of the central plate 105, the bottom being equipped with a central longitudinal slot in order to define a passage for the knife 65.

Each rung 107 is equipped with teeth 111 oriented in the direction of the cover 27 of the clasp.

The adjusting device according to the third embodiment has a control element 116 consisting of three main parts, namely a support 117 on either side of which are arranged a control plate 118 and a driving element 119.

The control plate and the driving element are fastened to each other by means of a screw 120 in such a way that they can slide together relative to the support 117, in the longitudinal direction of the bracelet.

Advantageously, and with no limitation being implied, the control plate—driving element unit can slide between two positions which are determined by means of ball catches 122, or other equivalent devices, arranged in the support 117 so as to interact with two holes (not shown) formed on the underside of the control plate.

Moreover, the support 117 is mechanically connected to the frame 95 by means of screws 124 which are designed so as to allow play (vertical in FIG. 5) between the relative positions of the support and the frame. Springs 125 are arranged on the screws so as to exert a force on the support 117 which tends to push it towards the cover 27 of the clasp.

Figure 6:
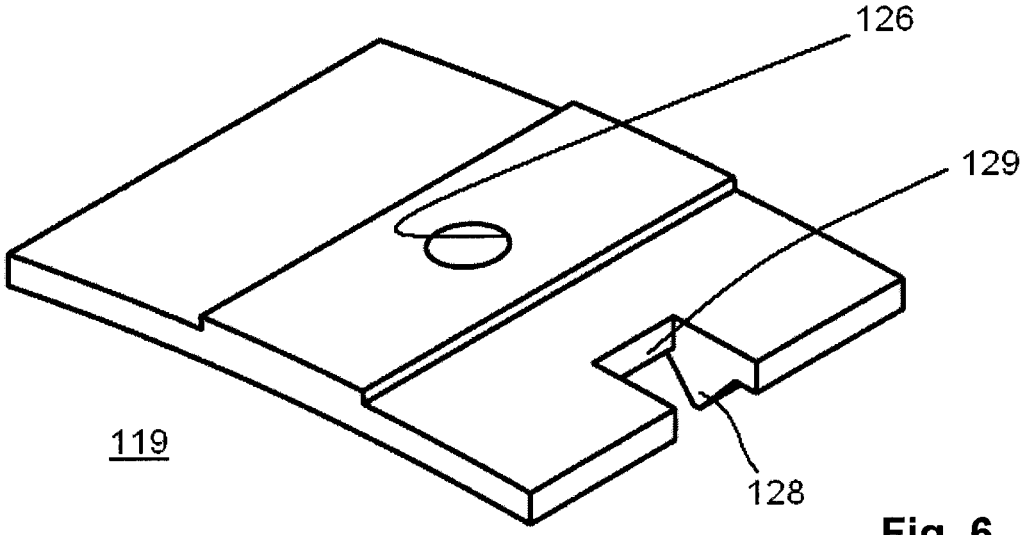
FIG. 6 shows a perspective view of a first constituent element of the clasp in FIG. 5.

FIG. 6 illustrates, in a perspective view, the structural details of the driving element 119. The hole 126, intended to allow the placing of the screw for fastening the driving element to the control plate 118, can in particular be seen here.

It can also be seen from FIG. 6 that the driving element has projections 128 arranged on either side of a notch 129.

The projections 128 are intended to fulfill a similar function to that of the projections 68 of the previous embodiment, namely to act on the teeth of the toothed rungs 107 in order to cause a displacement of the adjusting element.

Figure 7:
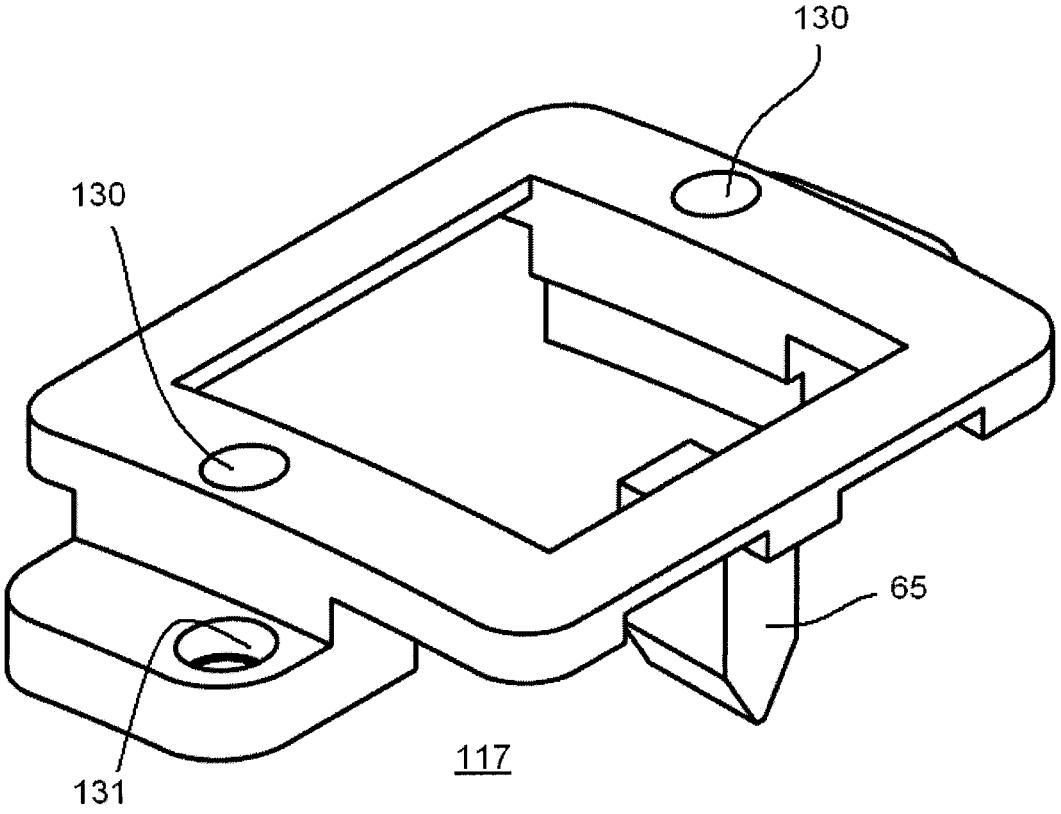
FIG. 7 shows a perspective view of a second constituent element of the clasp in FIG. 5.

FIG. 7 illustrates, in a perspective view, the structural details of the support 117. The blind holes 130 intended to house the ball catches 122, and the holes 131 intended to allow the placing of the screws 124, can in particular be seen here.

According to the description of the previous embodiments, the support 117 carries a knife 65 intended to interact with the jaws 54 in order to open them and free the teeth 134 and 135 of the adjusting element 98.

A comparison of the views in FIGS. 6 and 7 also makes apparent the function of the notch 129, intended to allow the driving element 119 to slide relative to the support without the former being obstructed by the knife 65, dimensioned so that it can be inserted into the notch.

It will be noted that the sets of teeth 134 and 135 have symmetrical teeth in this third preferred embodiment, in contrast to the sawteeth in the previous embodiments.

Indeed, the present embodiment provides that the adjusting device allows the bracelet to be shortened or lengthened as required by the user, simply by acting on the control element 116.

Thus, the user can select either of these two options by placing the control panel in that one of its positions which corresponds to said option.

Figure 8A:
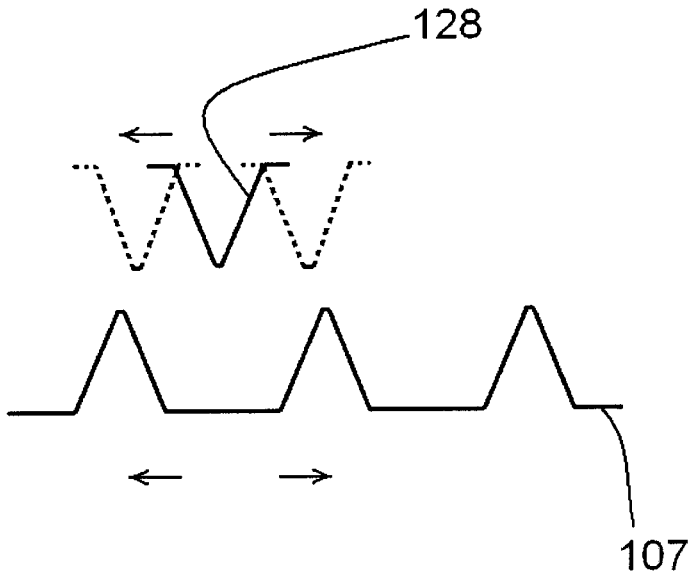
FIGS. 8*a* and 8*b* show diagrammatic views illustrating in detail how the clasp in FIG. 5 functions.
Figure 8B:
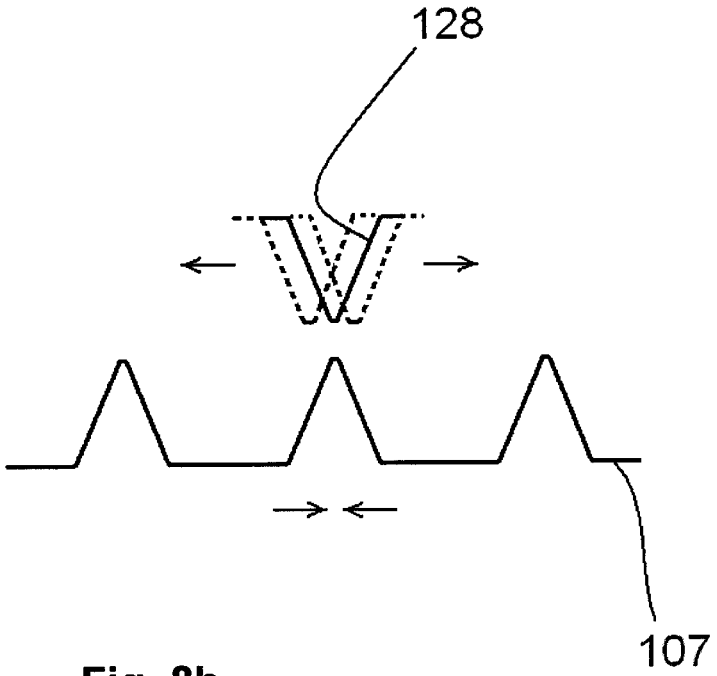

FIGS. 8*a* and 8*b* illustrate diagrammatically examples of operating modes of the adjusting device which has just been described.

In particular, if the control plate is placed in its position situated on the left-hand side in FIGS. 5 and 8*a* , and the control element is then pressed towards the frame 95, the knife 65 opens the jaws 54 and at least one of the projections 128 comes into contact with the toothed rung 107 with which it is associated. This contact takes place at the contact surfaces situated on that flank of the corresponding teeth which is situated on the right-hand side in FIGS. 5 and 8*a*. The projection 128 thus exerts a force on the rung which tends to push it towards the left in FIGS. 5 and 8*a* , corresponding to a shortening of the bracelet.

Conversely, if the control plate is placed in its position situated on the right-hand side in FIGS. 5 and 8*a* , the corresponding contact surfaces of the toothed rungs will be situated on that flank of the teeth which is situated on the left-hand side in FIGS. 5 and 8*a*. The other projection 128 thus exerts a force on the other rung which tends to push it towards the right in FIGS. 5 and 8*a* , corresponding to a lengthening of the bracelet.

It will be noted that, in the version of the device illustrated in FIG. 5, the teeth 111 of the rungs 107 are offset relative to each other such that just one projection 128 acts on the rung associated with it in each of the two positions of the control plate.

As in the previous embodiment, the initial displacement of one of the toothed rungs 107 causes the corresponding spring 109 to be compressed, said spring 109, as it slackens, imparting a force to the adjusting element and causing the latter to be displaced further, in the same direction.

Alternatively, it can be provided that the sets of teeth are aligned, but in this case two additional springs 109 are preferably provided in addition to those shown, whereas the projections then act simultaneously.

It is moreover possible to provide that the projections 128 have a neutral central position, illustrated in solid lines, in which acting on the control element has no effect. The two active configurations of the projections 128 are illustrated in broken lines in FIG. 8*a*.

FIG. 8*b* illustrates, also diagrammatically, an alternative embodiment based on a relative positioning of the projections and the teeth which differs from that in FIG. 8*a* , the operating principle remaining similar. In this case, it can be seen that the projection 128 acts on the same tooth, whether in its first or second configuration. However, the pressure is exerted on one or another flank, causing a displacement in one or another direction.

As in the previous embodiments, the rear surface of each of the projections 128 acts as a stop surface in relation to that tooth of the rung 107 which follows the one against which has been pushed by the projection.

The association of the projections 128 with the toothed rungs 107 therefore forms a conversion mechanism which makes it possible to generate a sliding movement of the adjusting element in the longitudinal direction of the bracelet simply by pressing on the control element 116.

As an alternative to what was described above, it can be provided that, in the configurations illustrated in FIGS. 8*a* and 8*b* , the action of the projection 128 on the abutment surface initiates the displacement of the adjusting element. Whilst the control element is depressed, there is friction between the projection 128 and the rung 107 which locks the adjusting element in this position. When the user lets go of the control element, the jaws 54 close on the sets of teeth 134, 135 and exert a force on them which is sufficient to complete the displacement of the adjusting element by one whole increment. In this case, the increment is defined by the tooth spacing of the racks.

Figure 9:
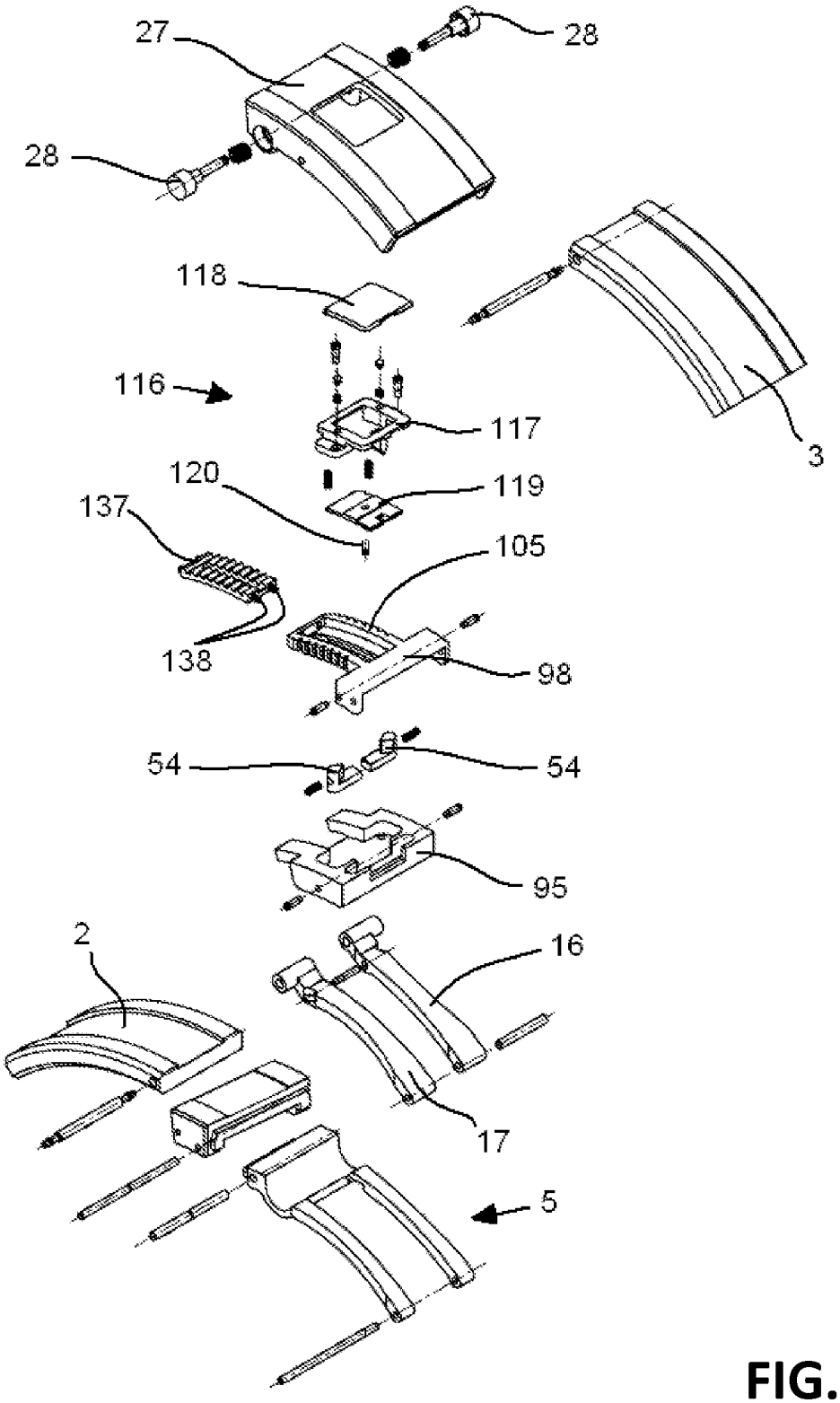
FIG. 9 shows an exploded perspective view of a bracelet clasp according to an alternative to the third embodiment illustrated in FIG. 5.

FIG. 9 shows an exploded perspective view of a bracelet clasp according to an alternative to the third embodiment in FIG. 5.

The two toothed rungs in FIG. 5 here take the form of a single piece forming a double rung 137, mounted in the central plate 105 with a certain amount of play by means of springs 138.

Here too, the teeth of the two rungs can be aligned or offset, the relative arrangement of the projections 128 being adapted to the solution selected.

This alternative embodiment functions in an identical fashion to that described above in relation to FIG. 5 to 7 and which consequently will not be described in more detail here.

Further alternative embodiments may be provided which are not illustrated.

Thus, it can be provided, according to a first additional alternative embodiment, that the basic structure of this clasp is similar to what was described above, the differences being in the construction and functioning of the adjusting device itself.

The adjusting element may be made as a single piece having a frame equipped with horns for fastening one end of the bracelet, and from which a tongue extends.

The tongue may comprise two lateral racks intended to interact with jaws in a similar fashion to that described above.

An additional rack may be provided on the upper face of the tongue with the aim of controlling the displacements of the adjusting element during the operations of altering the length of the bracelet.

The tongue is intended to rest on a base which also performs a guiding role. Furthermore, the base may comprise open slots in its side walls, which slots are intended to interact with fingers provided on the sides of the adjusting element, in order to improve the guidance of the latter in the base. The slots may also be employed when the unit is assembled, to allow the adjusting element to be placed on the base.

Each jaw may be screwed on the base, and rest partially in a counterbore of the base which allows it to be positioned properly. Each jaw may comprise a tooth on which a compression spring exerts a force that tends to push the tooth out of the jaw and towards the corresponding rack. A screw which is fastened to the tooth may be arranged so as to interact directly with the rack, so as to allow the interaction between the jaw and the teeth of the rack to be adjusted. For their part, the teeth are intended to be actuated by a knife carried by the control element.

The latter may have a support associated with a control plate, these two elements behaving as one in translation in a direction perpendicular to the overall mid plane of the clasp, whilst at the same time being capable of sliding relative to each other in the longitudinal direction of the bracelet, by dint of the use of a screw fastening, the screw being possibly housed in a slot of the control plate.

A ball catch may be mounted in the support so that it can interact with three blind holes formed in the lower face of the control plate, in order to mark three relative positions between the support and the control plate (one position for lengthening the bracelet, one for shortening it and, possibly, a neutral position).

The control element may be assembled to the base by means of four posts, each of which has one end set in the support and interacts with a foot arranged in a through hole formed in the base, with a shouldered collar placed in between.

A helical spring may be threaded over each of the posts in order to exert a force on the control element which tends to push it away from the base.

A pusher, in the form of a bow or rocker, may be mounted pivotably on the support, via a rod held in the support via clips.

An additional rod may be carried by the support, on the pusher, to allow the arrangement of two springs acting on the support, on the one hand, and on the pusher, on the other hand, so as to tend to position the latter in a vertical angular position, in other words substantially perpendicular to the support.

The pusher may have two free ends arranged through slots formed in the support so as to interact with suitable housings in the control plate.

The base of the pusher may for its part be arranged in proximity to the additional rack in order to interact with the latter in a manner which is explained below.

First, the control plate may be displaced towards a first direction by a user, for instance towards the part of the bracelet which is fastened to the adjusting element.

During this movement, the control plate acts on the free ends of the pusher, thus causing the latter to pivot in the support.

In such a situation, the pusher extends in an inclined direction with reference to the perpendicular to the additional rack, the base of the pusher being situated opposite a first notch of the additional rack.

In such a configuration of the pusher, the control element can be pressed by the user.

The base of the pusher consequently engages in the first notch and exerts a force on the additional rack which tends to push it in a direction opposite to that of the control plate displacement, i.e. in the direction which corresponds to a shortening of the bracelet.

When the user lets go of the control element, it rises under the effect of the force exerted by the corresponding springs on the support, whereas the pusher resumes its initial inclined direction under the effect of the action of one of the corresponding springs.

It will be noted that the additional rack is displaced by one adjustment increment in this operation, the base of the pusher then being located opposite the notch adjacent to the first notch. If the user presses the control element again in this situation, the additional rack is displaced by another notch in the direction which shortens the bracelet.

If the user restores the control plate to its central position, the pusher resumes its vertical configuration.

Conversely, when the control plate is displaced in the opposite direction, the pusher extends in a direction inclined to the other side with reference to the perpendicular to the rack in such a way that its base is arranged opposite a second notch of the additional rack.

When the control element is pressed by the user, in this configuration, the base engages in the second notch and exerts a force on the additional rack which tends to push it in a direction opposite to that of the control plate displacement, i.e. in the direction which corresponds to a lengthening of the bracelet.

When the user lets go of the control element, it rises under the effect of the force exerted by the corresponding springs on the support, whereas the pusher resumes its initial inclined direction under the effect of the action of another corresponding spring.

The additional rack is displaced by one adjustment increment in this operation, the base of the pusher then being located opposite the notch adjacent to the second notch. If the user presses the control element again in this situation, the additional rack is displaced by another notch in the direction which lengthens the bracelet.

It will be noted that two posts are advantageously provided in the control plate in order to define abutments with relation to the base and prevent the control element from being pressed when the control plate is arranged in its central position.

A further alternative embodiment may be provided which differs substantially from the previous one, in particular in the structure of the jaws and of the control element.

Each jaw may have a lateral extension which allows it to be assembled to the base by means of screws. Furthermore, each extension may carry a bearing intended for the mounting of a toothed pinion arranged so as to interact with the additional rack of the adjusting element.

Moreover, the control plate and the base may be assembled by means of screws which traverse slots, formed in the base, and are screwed into the control plate.

The control plate may carry first and second bearings, each arranged so as to support a rod which defines an axis of rotation for a pusher. Each rod may also carry a spring arranged so as to interact, on the one hand, with the control plate and, on the other hand, with the corresponding pusher, in order to maintain the latter in a raised position.

The base may be equipped with openings through which the pushers are arranged, in such a way that the control plate can slide with reference to the base. The pushers can thus be arranged in first and second configurations, depending on the relative position between the control plate and the support.

As in the previous embodiment, the control element may be mounted on the base in such a way that it can be displaced in translation, in a direction substantially perpendicular to the additional rack, in response to a predefined action by the user.

In each of the abovementioned configurations, a single pusher is active, in other words is situated within range of the toothed pinion, and is capable of rotating it when the control element is pressed by the user.

Thus, when the control plate is displaced in a first direction, one of the pushers approaches the toothed pinion and is able to rotate it in a first direction of rotation when the control element is actuated by the user.

This operation may cause the bracelet to be lengthened.

Advantageously, the pusher is retracted, passing the toothed pinion, when the control element is released and rises back into its rest position, under the effect of the action of suitable springs.

In a similar fashion, when the control plate is displaced in the opposite direction, the other pusher approaches the toothed pinion and is able to rotate it the opposite direction of rotation when the control element is actuated by the user.

This operation may cause the bracelet to be shortened.

The second pusher is also retracted, passing the toothed pinion, when the control element is released and rises back into its rest position, under the effect of the action of the corresponding springs.

The above description describes particular embodiments by way of non-limiting illustration, and the invention is not limited to the implementation of certain particular features which have just been described, such as for example the shapes which were specifically illustrated and described for the clasp, the control element, the adjusting element or the frame of the adjusting device. Likewise, the mechanical connection elements, such as the screws, springs or ball catches, have been illustrated and described by way of a non-limiting example.

A person skilled in the art will encounter no particular difficulty in adapting the content of the present disclosure for his own purposes and implementing a device for adjusting the usable length of a bracelet, replicating the features inherent in the present invention, in particular a conversion mechanism designed so as to convert an action by a user on the control element of the device into a sliding movement of its adjusting element by one predefined adjustment increment, and allow the usable length of the bracelet to be adjusted simply by pressing on the control element.

The rungs (first and second embodiments) or teeth of the rungs (third embodiment) are aligned but could alternately be offset relative to one another without going beyond the scope of the present invention. The projections would of course have modified positions.

As has already been emphasized above, it is possible to have just a single rack associated with a single jaw, in the same way as it is possible to have just a single projection or pusher associated with just one side of ladder rungs or with just one toothed rung. Likewise, the invention is not limited by the nature of the element which defines the increments by which the adjusting element advances relative to the frame of the adjusting device. A person skilled in the art could adapt its construction depending on his own needs without going beyond the scope of the invention.

It could also be provided as an alternative that, in the third embodiment, the control plate 118—driving element 119 unit slides in a direction perpendicular to the longitudinal direction of the bracelet in order to select the lengthening or shortening of the bracelet. The projections would then be arranged in such a way that each would have two alternative positions, one in which it would be within range of the corresponding teeth and the other in which it would be out of range of the teeth, the relative positions of the two projections being out of sync.

The invention claimed is:

1. A device for adjusting the usable length of a bracelet comprising first and second free ends, the adjusting device having a frame carrying an adjusting element intended to be fastened to the first free end of the bracelet and capable of sliding in the longitudinal direction of the bracelet with reference to said frame, an element for fastening the bracelet, at least indirectly mechanically connected to said frame and intended to be fastened to the second free end of the bracelet, said adjusting element carrying a toothed rack as well as rungs, both being oriented in the longitudinal direction of the bracelet, a jaw which can move between inactive and active positions, in response to a predefined action by a user on a control element, said jaw being designed so as to cooperate with said toothed rack, to define a plurality of distinct adjustment positions in the longitudinal direction of the bracelet, and lock said adjusting element in said active position, and leave it free in said inactive position, so as to allow said adjusting element to slide from one to another of said adjustment positions, two adjacent distinct adjustment positions defining an adjustment increment for the usable length of the bracelet, wherein said control element bears both a knife, intended to cooperate with said jaw to move it into its inactive position, and a projection, intended to cooperate with said rungs, said projection being positioned such that a stop surface faces said rungs as said jaw is in its inactive position and such that said adjusting element is enabled to slide by one adjustment increment only for each of said predefined action by the user on said control element, to allow the usable length of the bracelet to be adjusted.

2. The adjusting device of claim 1, wherein said toothed rack is integral with said adjusting element.

3. The adjusting device of claim 1, wherein said knife is integral with said control element.

4. The adjusting device of claim 1, wherein said projection is arranged so as to exert a pressure, having a component oriented in a first direction in the longitudinal direction of the bracelet, on a first among several abutment surfaces mechanically connected to said adjusting element when said jaw is placed in its inactive position by said knife.

5. The adjusting device of claim 2, wherein said projection is arranged so as to exert a pressure, having a component oriented in a first direction in the longitudinal direction of the bracelet, on a first among several abutment surfaces mechanically connected to said adjusting element when said jaw is placed in its inactive position by said knife.

6. The adjusting device of claim 3, wherein said projection is arranged so as to exert a pressure, having a component oriented in a first direction in the longitudinal direction of the bracelet, on a first among several abutment surfaces mechanically connected to said adjusting element when said jaw is placed in its inactive position by said knife.

7. The adjusting device of claim 4, further having at least one spring which tends to displace said adjusting element, whereas said projection defines a stop surface arranged so as to interact at least indirectly with one of said rungs when said adjusting element is displaced by one increment.

8. The adjusting device of claim 4, wherein said projection is arranged on said adjusting device so that it can move between first and second configurations, so that it is capable of acting on said first abutment surface in the first configuration and so that it is capable of acting on a second abutment surface, when it is placed in its second configuration, in order to exert on it a pressure oriented in the opposite direction to said first direction.

9. The adjusting device of claim 4, wherein it comprises a second projection carried by said control element and arranged so as to exert a pressure, having a component oriented in the longitudinal direction of the bracelet, in the opposite direction to said first direction, on a second abutment surface mechanically connected to said adjusting element when said jaw is placed in its inactive position by said knife, said first and second projections being capable of moving between first and second configurations in such a way that only said first projection is active in said first configuration, whereas only said second projection is active in said second configuration.

10. The adjusting device of claim 7, wherein said abutment surfaces are carried by a ladder, comprising a plurality of rungs, mechanically connected to said adjusting element and arranged in such a way that the or one of said projections comes into contact with a given rung of said ladder, defining one of said abutment surfaces, when said knife opens said jaw, whereas said adjustment increment is defined by the travel made by said ladder until another rung comes into contact with said or with at least one of said projections, defining one of said stop surfaces.

11. The adjusting device of claim 10, wherein said knife is arranged through said ladder, at least some of the rungs of the latter being truncated in their central region.

12. The adjusting device of claim 8, wherein abutment surfaces are carried by at least one toothed rung connected mechanically to said adjusting element and arranged in such a way that said or one of said projections comes into contact with a given tooth of said rung, defining one of said abutment surfaces, when said knife displaces said jaw into its inactive position, whereas said adjustment increment is defined by the travel made by said rung until one of its teeth comes into contact with said or at least one of said projections, defining a stop surface.

13. The adjusting device of claim 8, wherein said control element is designed so as to be able to be displaced in a direction substantially perpendicular to the longitudinal direction of the bracelet in order to act on said adjusting element, and has a driving element carrying the or said projections and designed so as to be able to be displaced in a plane substantially parallel to a general plane of the adjusting device, with reference to said knife, in order to define said first and second configurations.

14. The adjusting device of claim 1, further having an additional rack associated with a second jaw which can move between inactive or active positions, the adjusting device comprising said knife being arranged so as to shift said jaws simultaneously into their inactive position, in response to said predefined action of the user on said control element.

15. A bracelet clasp having an adjusting device as claimed in claim 1.

16. A bracelet clasp having an adjusting device as claimed in claim 2.

17. A bracelet clasp having an adjusting device as claimed in claim 3.

18. A bracelet clasp having an adjusting device as claimed in claim 4.

19. A bracelet clasp having an adjusting device as claimed in claim 7.

20. A bracelet clasp having an adjusting device as claimed in claim 8.

* * * * *